US007155019B2

(12) United States Patent
Hou

(10) Patent No.: US 7,155,019 B2
(45) Date of Patent: Dec. 26, 2006

(54) ADAPTIVE MICROPHONE MATCHING IN MULTI-MICROPHONE DIRECTIONAL SYSTEM

(75) Inventor: Zezhang Hou, Cupertino, CA (US)

(73) Assignee: Apherma Corporation, Sunnyvale, CA (US)

( * ) Notice: Subject to any disclaimer, the term of this patent is extended or adjusted under 35 U.S.C. 154(b) by 1008 days.

(21) Appl. No.: 09/808,694

(22) Filed: Mar. 14, 2001

(65) Prior Publication Data

US 2002/0034310 A1 Mar. 21, 2002

Related U.S. Application Data

(60) Provisional application No. 60/189,282, filed on Mar. 14, 2000.

(51) Int. Cl.
*H04R 3/00* (2006.01)

(52) U.S. Cl. ..... 381/92; 381/313

(58) Field of Classification Search ..... 381/92, 381/94.1, 94.9, 313, 71.7, 71.6, 71.11
See application file for complete search history.

(56) References Cited

U.S. PATENT DOCUMENTS

| | | | | |
|---|---|---|---|---|
| 3,836,732 A | | 9/1974 | Johanson et al. | |
| 3,975,599 A | | 8/1976 | Johanson | |
| 4,131,760 A | | 12/1978 | Christensen et al. | |
| 4,245,313 A | * | 1/1981 | Coates | 702/13 |
| 4,701,953 A | | 10/1987 | White | |
| 4,712,244 A | | 12/1987 | Zwicker et al. | |
| 4,751,738 A | | 6/1988 | Widrow et al. | |
| 4,956,867 A | | 9/1990 | Zurek et al. | |
| 5,214,709 A | | 5/1993 | Ribic | |
| 5,325,436 A | | 6/1994 | Soli et al. | |
| 5,390,254 A | | 2/1995 | Adelman | |
| 5,434,924 A | | 7/1995 | Jampolsky | |
| 5,471,538 A | * | 11/1995 | Sasaki et al. | 381/92 |
| 5,479,522 A | | 12/1995 | Lindemann et al. | |
| 5,524,056 A | | 6/1996 | Killion et al. | |
| 5,625,684 A | | 4/1997 | Matouk et al. | |
| 5,737,430 A | | 4/1998 | Widrow | |
| 5,740,256 A | | 4/1998 | Castello Da Costa et al. | |
| 5,757,933 A | | 5/1998 | Preves et al. | |
| 6,268,725 B1 | * | 7/2001 | Vernon et al. | 324/253 |
| 6,285,768 B1 | * | 9/2001 | Ikeda | 381/71.11 |
| 6,654,468 B1 | * | 11/2003 | Thompson | 381/92 |

FOREIGN PATENT DOCUMENTS

| | | |
|---|---|---|
| EP | 569216 A1 | 11/1993 |
| EP | 06 269085 | 9/1994 |
| EP | 0856833 A2 | 8/1998 |
| EP | 982971 A2 | 8/1999 |
| JP | 63-002500 | 1/1988 |

(Continued)

OTHER PUBLICATIONS

Glover, "A review of Cardioid Type Unidirectional Microphones", (Jan. 1940) J.A.S.A., vol. 11, pp. 296-302.

(Continued)

*Primary Examiner*—Vivian Chin
*Assistant Examiner*—Justin Michalski
(74) *Attorney, Agent, or Firm*—Beyer Weaver & Thomas LLP

(57) ABSTRACT

Improved approaches to matching sensitivities of microphones in multi-microphone directional processing systems. These approaches operate to adaptively match microphone sensitivities so that directional noise suppression is robust. As a result, microphone sensitivities remain matched not only over time but also while in actual use. These approaches are particularly useful for hearing aid applications in which directional noise suppression is important.

14 Claims, 14 Drawing Sheets

FOREIGN PATENT DOCUMENTS

| | | |
|---|---|---|
| JP | 11-220796 | 8/1999 |
| WO | WO 99/03091 | 1/1999 |

OTHER PUBLICATIONS

Killion et al., "The case of the missing dots: AI and SNR loss", (May 1998) The Hearing Journal, vol. 51, No. 5, pp. 1-6.
Gravel et al., "Children's Speech Recognition in Noise Using Omni-Directional and Dual-Microphone Hearing Aid Technology", Ear & Hearing, Feb. 1999, pp. 1-11.
Ricketts et al., "Comparison of Performance across Three Directional Hearing Aids", J Am Acad Audiol vol. 10, 1999, pp. 180-189.
Buerkli-Halevy, "The directional microphone advantage", Hearing Instruments, vol. 38, No. 8, 1987.
Preves, "Directional Microphone Use in ITE Hearing Instruments", The Hearing Rev., Jul. 1997, pp. 21-27.
Greenberg et al., "Evaluation of an adaptive beamforming method for hearing aids", J. Acoust. Soc. Am. 91 (3), Mar. 1992, pp. 1662-1676.
Agnew, "How multi-microphone arrays can improve directionality", The Hearing Journal, vol. 50, No. 8, Aug. 1997, pp. 34-46.
Roberts et al., "Measurement and Intelligibility Optimization of Directional Microphones for Use in Hearing Aid Devices", 103rd Convention of Audio Engineering Society (AES), Sep. 1997, 13 pp.
Desloge et al., "Microphone-Array Hearing Aids with Binaural Output—Part I: Fixed-Processing Systems", IEEE Trans. on Speech & Audio Proc., vol. 5, No. 6, Nov. 1997, pp. 529-542.
Welker et al., "Microphone-Array Hearing Aids with Binaural Output—Part II: A Two-Microphone Adaptive System", IEEE Trans. On Speech & Audio Proc., vol. 5, No. 6, Nov. 1997, pp. 543-551.
Greenberg, "Modified LMS Algorithms for Speech Processing with an Adaptive Noise Canceller", IEEE Trans. On Speech & Audio Proc., vol. 6, No. 4, Jul. 1998, pp. 338-351.
Van Tasell, "New DSP instrument designed to maximize binaural benefits", , The Hearing Journal, vol. 51, No. 4, Apr. 1998, pp. 40-49.
Edwards et al., "New digital processor for hearing loss compensation is based on auditory system", The Hearing Journal, vol. 51, No. 8, Aug. 1998.
Stadler et al., "On the potential of fixed arrays for hearing aids", J. Acoust. Soc. Am. 94 (3), Pt. 1, Sep. 1993, pp. 1332-1342.
Zurek et al., "Prospects and Limitations of Microphone-Array Hearing Aids", World Scientific, Aug. 1995, pp. 233-244.
Killion et al., "Real-world performance of an ITE directional microphone", The Hearing Journal., vol. 51, No. 4, Apr. 1998, pp. 1-6.
Killion, "SNR Loss: 'I Can *Hear* What People Say, But I Can't *Understand* Them'", The Hearing Rev., vol. 4, No. 12, Dec. 1997.
Edwards et al., "Signal-processing algorithms for a new software-based, digital hearing device", The Hearing Journal, vol. 51, No. 9, Sep. 1998.
Killion, "The SIN report: circuits haven't solved the hearing-in-noise problem", The Hearing Journal., vol. 50, No. 10, Oct. 1997, pp. 28-31.
Cadalli et al., "Wideband Maximum Likelihood Direction Finding and Signal Parameter Estimation by Using the Tree-Structured EM Algorithm", IEEE Trans. On Signal Proc., vol. 47, No. 1, Jan. 1999, pp. 201-206.
Souza et al., "Quantifying the Contribution of Audibility to Recognition of compression-Amplified Speech", Ear & Hearing, vol. 20, No. 1, Feb. 1999, pp. 12-20.
microZOOM™, Marketing pamphlet, Phonak, 2 pgs.
Senso: The Single Most Advanced Hearing Instrument Ever Developed, Marketing pamphlet, Widex, 2 pgs.
"HJReport", The Hearing Journal, vol. 50, No. 8, Aug. 1997, pp. 7-8.
International Search Report, EPO/ISA, re PCT/US01/08256, dated Aug. 2, 2002.

* cited by examiner

ADAPTIVE MICROPHONE MATCHING IN MULTI-MICROPHONE DIRECTIONAL SYSTEM

CROSS-REFERENCE TO RELATED APPLICATIONS

This application claims the benefit of U.S. Provisional Application No. 60/189,282, filed Mar. 14, 2000, and entitled "METHODS FOR ADAPTIVE MICROPHONE MATCHING IN MULTI-MICROPHONE DIRECTIONAL SYSTEM", the contents of which is hereby incorporated by reference. This application is also related to U.S. application Ser. No. 09/788,271, filed Feb. 16, 2001, and entitled "NULL ADAPTATION IN MULTI-MICROPHONE DIRECTIONAL SYSTEM", the contents of which is hereby incorporated by reference.

BACKGROUND OF THE INVENTION

1. Field of the Invention

The present invention relates to multi-microphone sound pick-up systems and, more particularly, to matching microphone sensitivity in multi-microphone sound pick-up systems.

2. Description of the Related Art

Suppressing interfering noise is still a major challenge for most communication devices involving a sound pick up system such as a microphone or a multi-microphone array. The multi-microphone array can selectively enhance sounds coming from certain directions while suppressing interference coming from other directions.

FIG. 1 shows a typical direction processing system in a two-microphone hearing aid. The two microphones pick-up sounds and convert them into electronic or digital signals. The output signal form the second microphone is delayed and subtracted from the output signal of the first microphone. The result is a signal with interference from certain directions being suppressed. In other words, the output signal is dependent on which directions the input signals come from. Therefore, the system is directional. The physical distance between the two microphones and the delay are two variables that control the characteristics of the directionality. For hearing aid applications, the physical distance is limited by the physical dimension of the hearing aid. The delay can be set in a delta-sigma analog-to-digital converter (A/D) or by use of an all-pass filter.

The sensitivity of the microphones of the sound pick up system must be matched in order to achieve good directionality. When the sensitivities of the microphones are not properly matched, then the directionality is substantially degraded and thus the ability to suppress interference coming from a particular direction is poor. FIGS. 2(*a*), 2(*b*), 2(*c*) and 2(*d*) illustrate representative polar patterns for microphone sensitivity discrepancies of 0, 1, 2, and 3 dB, respectively. Note that the representative polar pattern shown in FIG. 2(*a*) is the desired polar pattern which offers maximized directionality. The representative polar patterns shown in FIGS. 2(*b*)–2(*d*) are distorted polar patterns that respectively illustrate directionality becoming progressively worse as the sensitivity discrepancy increases respectively from 1, 2 and 3 dB. FIGS. 3(*a*), 3(*b*), 3(*c*) and 3(*d*) illustrate representative spectrum response for microphone sensitivity discrepancies of 0, 1, 2, and 3 dB, respectively, with reference to a 1 kHz pure tone in white noise. Note that the Signal-to-Noise Ratio of the spectrum shown in FIGS. 3(*a*)–3(*d*) is 14, 11, 9 and 7 dB, respectively. Accordingly, a good match of sensitivity between microphones is very important to good directionality.

Conventionally, manufacturers manually match the microphone for their multi-microphone directional processing systems. While manual matching of the microphones provides for improved directionality, the operational or manufacturing costs are substantial. Besides cost-effectiveness, manual matching has other problems that compromise manual matching. One problem is that microphone sensitivity tends to drift over time. Hence, once matched microphones can become mismatched over time. Another problem is that the sensitivity difference can depend on how the multi-microphone directional processing systems is used. For example, in hearing aid applications, a microphone pair that is perfectly matched as determined by measurements at manufacture may become mismatched when the hearing aid is put on a patient. This can occur because at manufacture the microphones are measured in a field where sound pressure level is the same everywhere (free field), while in real life situation (in situ) sound pressure may not distribute uniformly at microphone locations. Hence, when such pressure differences result, the microphones are in effect mismatched. In another word, because the microphones are matched in free field, not in situ, the microphones can actually be mismatched when used in real life, which degrades directionality.

Some manufacturers have used a fixed filter in their designs of multi-microphone directional processing systems. FIG. 4 illustrates a conventional two-microphone directional processing system 400 having a first microphone 402, a second microphone 404, a delay 406, a fixed filter 408, and a subtraction unit 410. The fixed filter 408 can serve to compensate for a mismatch in microphone sensitivity. The fixed filter approach is more cost-effective that the manual matching. However, the other problems (e.g., drift over time and in-situ mismatch) of manual matching are still present with the fixed filter approach.

Thus, there is a need for improved approaches to match sensitivities of microphones in multi-microphone directional processing systems.

SUMMARY OF THE INVENTION

Broadly speaking, the invention relates to improved approaches to matching sensitivities of microphones in multi-microphone directional processing systems. These approaches operate to adaptively match microphone sensitivities so that directional noise suppression is robust. As a result, microphone sensitivities remain matched not only over time but also while in actual use. These approaches are particularly useful for hearing aid applications in which directional noise suppression is important.

The invention can be implemented in numerous ways including as a method, system, apparatus, device, and computer readable medium. Several embodiments of the invention are discussed below.

As an adaptive directional sound processing system, one embodiment of the invention includes at least: at least first and second microphones spaced apart by a distance, the first microphones producing a first electronic sound signal and the second microphone producing a second electronic sound signal; means for processing the second electronic sound signal to adaptively produce a compensation scaling amount that compensates for sensitivity differences between the first and second microphones; a scaling circuit operatively connected to the means for scaling and the second microphone, the scaling circuit operates to scale the second electronic sound signal in accordance with the compensation scaling amount; and a subtraction circuit operatively connected to the scaling circuit and the first microphone, the subtraction circuit producing an output difference signal by subtracting the scaled second electronic sound signal from the first electronic sound signal.

As an adaptive directional sound processing system, another embodiment of the invention includes at least: at least first and second microphones spaced apart by a predetermined distance, the first microphones producing a first electronic sound signal and the second microphone producing a second electronic sound signal; a first minimum estimate circuit operatively coupled to the first microphone, the first minimum estimate circuit produces a first minimum estimate for the first electronic sound signal from the first microphone; a second minimum estimate circuit operatively coupled to the second microphone, the second minimum estimate circuit produces a second minimum estimate for the second electronic sound signal from the second microphone; a divide circuit operatively connected to the first and second minimum estimate circuits, the divide circuit operates to produce a scaling signal from the first and second minimum estimates; a multiply circuit operatively connected to the divide circuit and the second microphone, the multiply circuit operates to multiply the second electronic sound signal by the scaling signal to produce a scaled second electronic sound signal; and a subtraction circuit operatively connected to the multiply circuit and the first microphone, the subtraction circuit producing an output difference signal by subtracting the scaled second electronic sound signal from the first electronic sound signal.

As a hearing aid device having an adaptive directional sound processing, one embodiment of the invention includes at least: at least first and second microphones spaced apart by a distance, the first microphones producing a first electronic sound signal and the second microphone producing a second electronic sound signal; sensitivity difference detection circuitry operatively connected to the first and second microphones, the sensitivity difference detection circuitry adaptively produces a compensation scaling amount corresponding to sensitivity differences between the first and second microphones; a scaling circuit operatively connected to the sensitivity difference detection circuitry and the second microphone, the scaling circuit operates to scale the second electronic sound signal in accordance with the compensation scaling amount; and a subtraction circuit operatively connected to the scaling circuit and the first microphone, the subtraction circuit producing an output difference signal by subtracting the scaled second electronic sound signal from the first electronic sound signal.

As a method for adaptively measuring and compensating for acoustical differences between sound signals picked up by microphones, one embodiment of the invention includes at least the acts of: receiving first and second electronic sound signals from first and second microphones, respectively; determining a compensation scaling amount that compensates for acoustic differences with respect to the first and second microphones; scaling the second electronic sound signal in accordance with the compensation scaling amount; and producing a differential electronic sound signal by subtracting the scaled second electronic sound signal from the first electronic sound signal.

Other aspects and advantages of the invention will become apparent from the following detailed description taken in conjunction with the accompanying drawings which illustrate, by way of example, the principles of the invention.

BRIEF DESCRIPTION OF THE DRAWINGS

The invention will be readily understood by the following detailed description in conjunction with the accompanying drawings, wherein like reference numerals designate like structural elements, and in which.

DETAILED DESCRIPTION OF THE INVENTION

The invention relates to improved approaches to matching sensitivities of microphones in multi-microphone directional processing systems. These approaches operate to adaptively match microphone sensitivities so that directional noise suppression is robust. As a result, microphone sensitivities remain matched not only over time but also while in actual use. These approaches are particularly useful for hearing aid applications in which directional noise suppression is important.

According to one aspect, the invention operates to adaptively measure a sensitivity difference between microphones in a multi-microphone directional processing system, and then compensate (or correct) an electronic sound signal from one or more of the microphones. As a result of the adaptive processing, the microphones "effectively" become matched and remain matched over time and while in use.

Consequently, the invention enables multi-microphone directional processing systems to achieve superior directionality and consistent Signal-to-Noise Ratio (SNR) across all conditions. The invention is described below with respect to embodiments particularly well suited for use with hearing aid applications. However, it should be recognized that the invention is not limited to hearing aid applications, but is applicable to other sound pick-up systems.

Embodiments of this aspect of the invention are discussed below with reference to FIGS. 5–11. However, those skilled in the art will readily appreciate that the detailed description given herein with respect to these figures is for explanatory purposes as the invention extends beyond these limited embodiments.

As noted above, microphone matching is important for multi-microphone directional systems. Different and undesired responses will result when the sensitivities of the microphones are not matched. The acoustic delay between the microphones further complicates matching problems. For example, even if the microphones are perfectly matched, the instantaneous response of the microphones can be different because of the delay and/or fluctuation in the acoustic signals. Therefore, it is not enough to simply use the difference of the responses to correct the problem. More complex processing is necessary to eliminate the effects of acoustic delay between the microphones and/or the fluctuation in the acoustic signals.

According to one aspect of the invention, responses from each microphone are processed such that the resulting processed signals are not sensitive to the acoustic delay between the microphones and the fluctuation of acoustic conditions. A difference between the processed signals from the microphone channels can then be used to scale at least one microphone's response so as to compensate or correct for sensitivity differences between the microphones.

Figure 1:
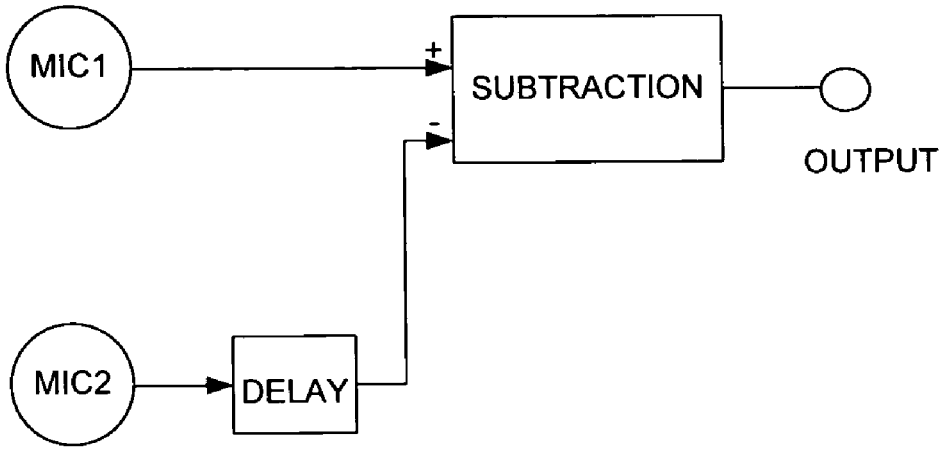
FIG. 1 shows a typical direction processing system in a two-microphone hearing aid.
Figure 4:
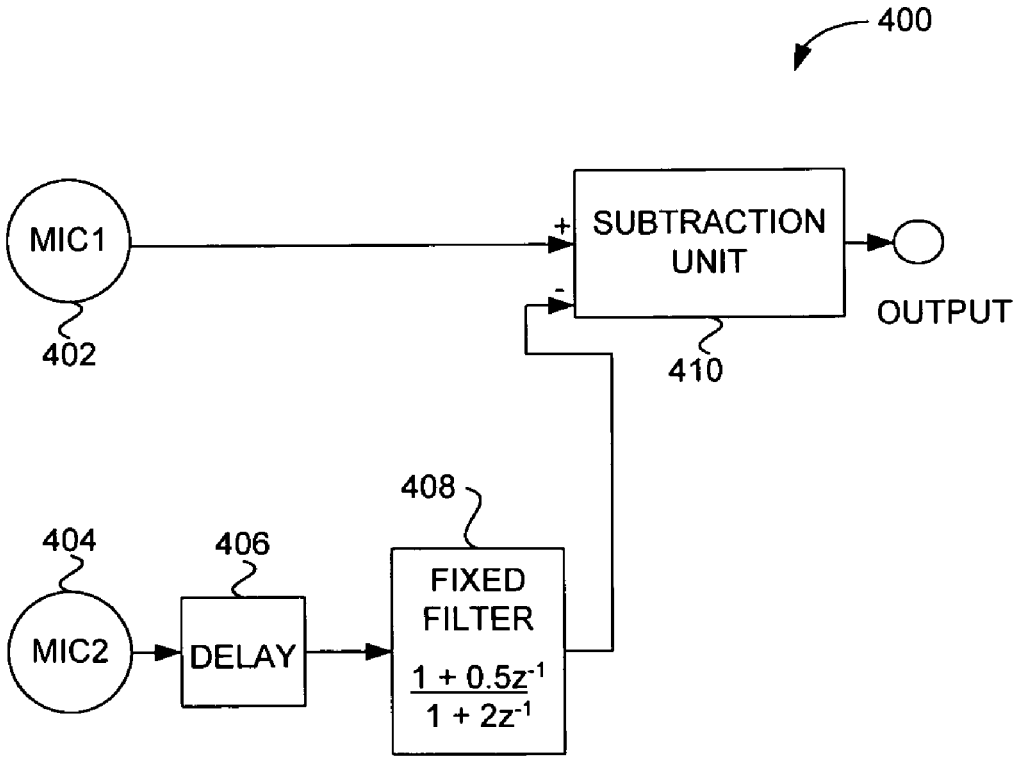
FIG. 4 illustrates a conventional two-microphone directional processing system.
Figure 2A:
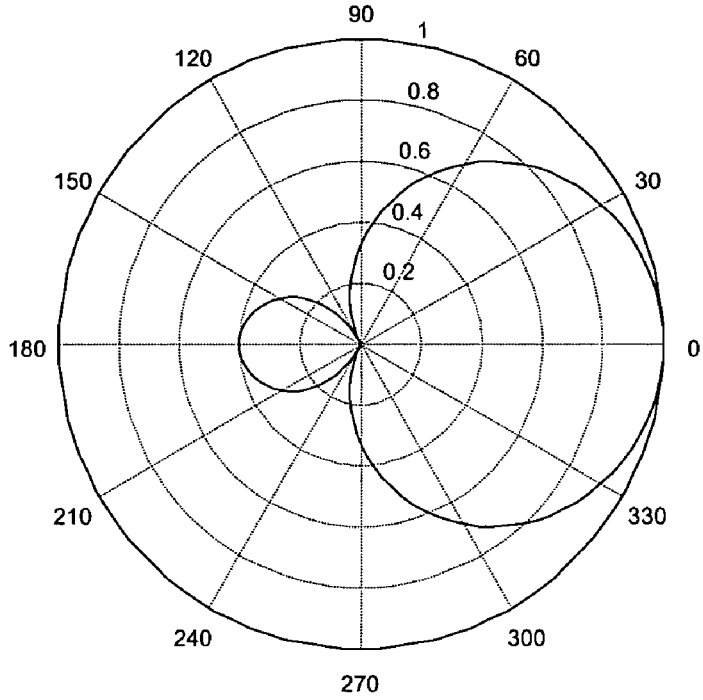
FIGS. 2(*a*)–2(*d*) illustrate representative polar patterns for various microphone sensitivity discrepancies.
Figure 2B:
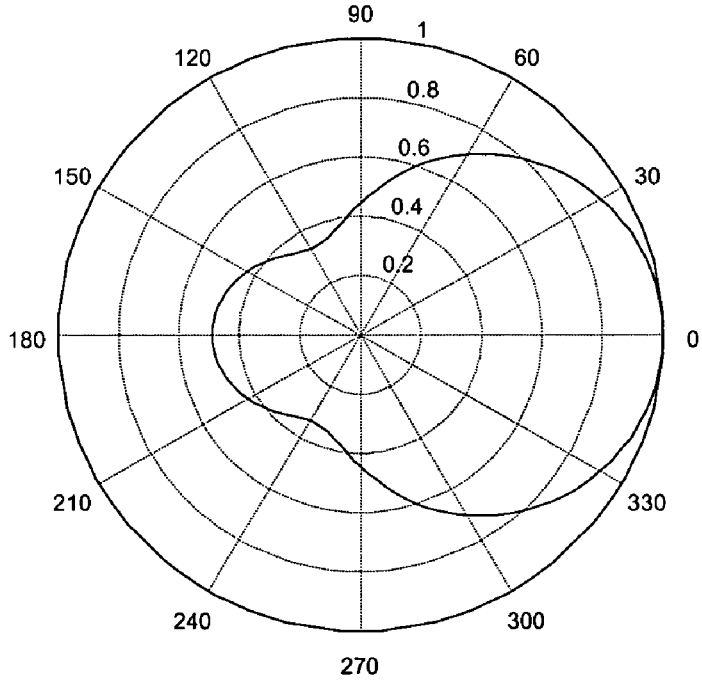
Figure 2C:
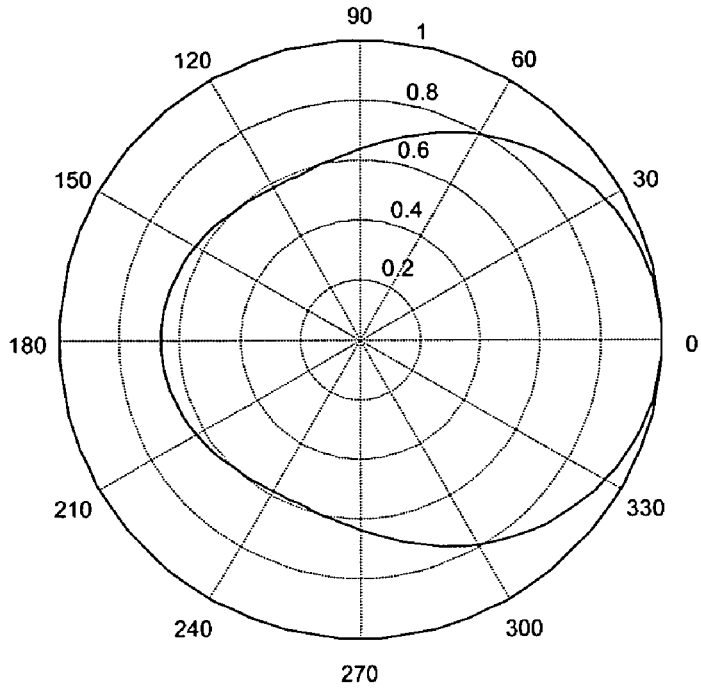
Figure 2D:
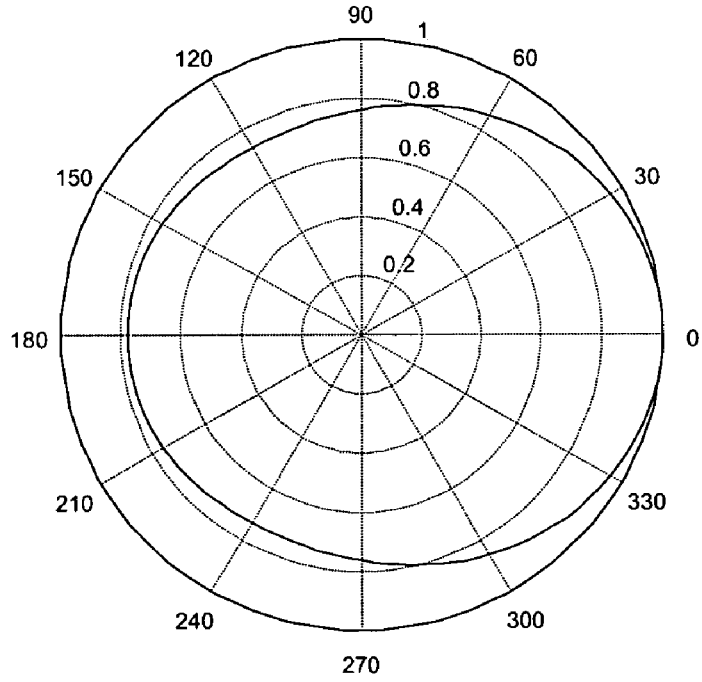
Figure 3A:
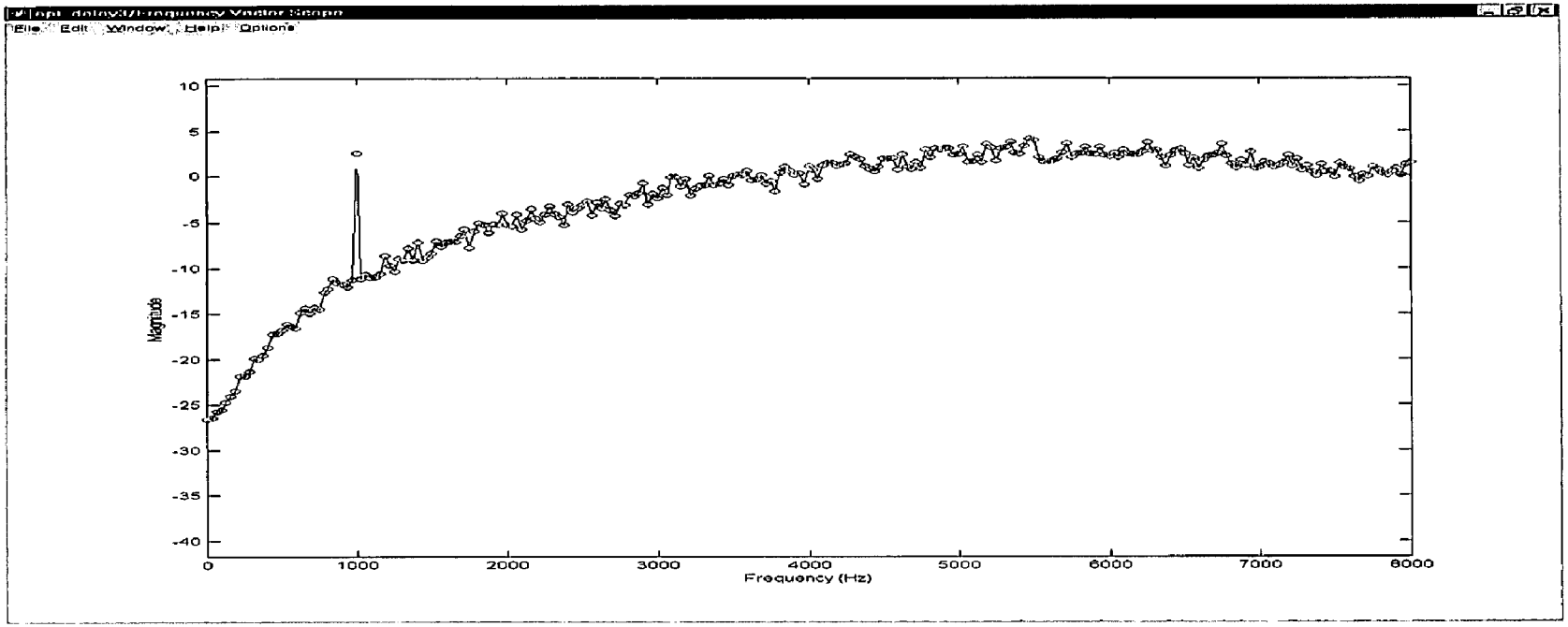
FIGS. 3(*a*)–3(*d*) illustrate representative Signal-to-Noise Ratio spectrums respectively corresponding to the representative polar patterns shown in FIGS. 2(*a*)–2(*d*)
Figure 3B:
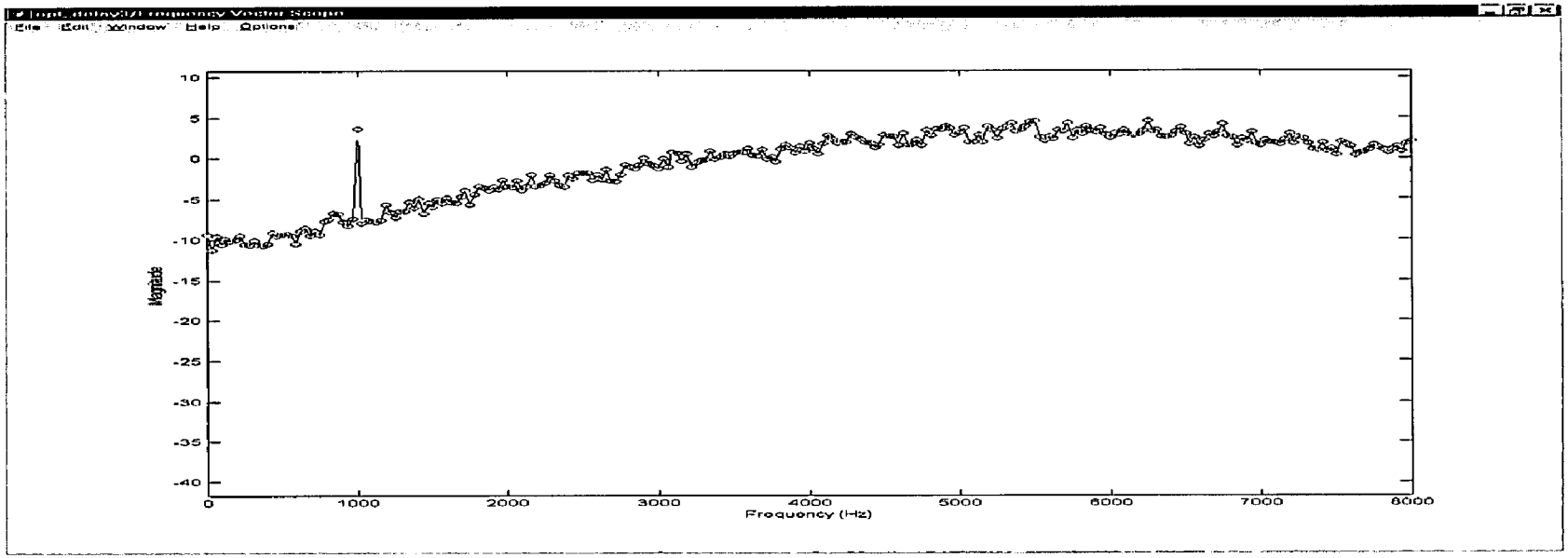
Figure 3C:
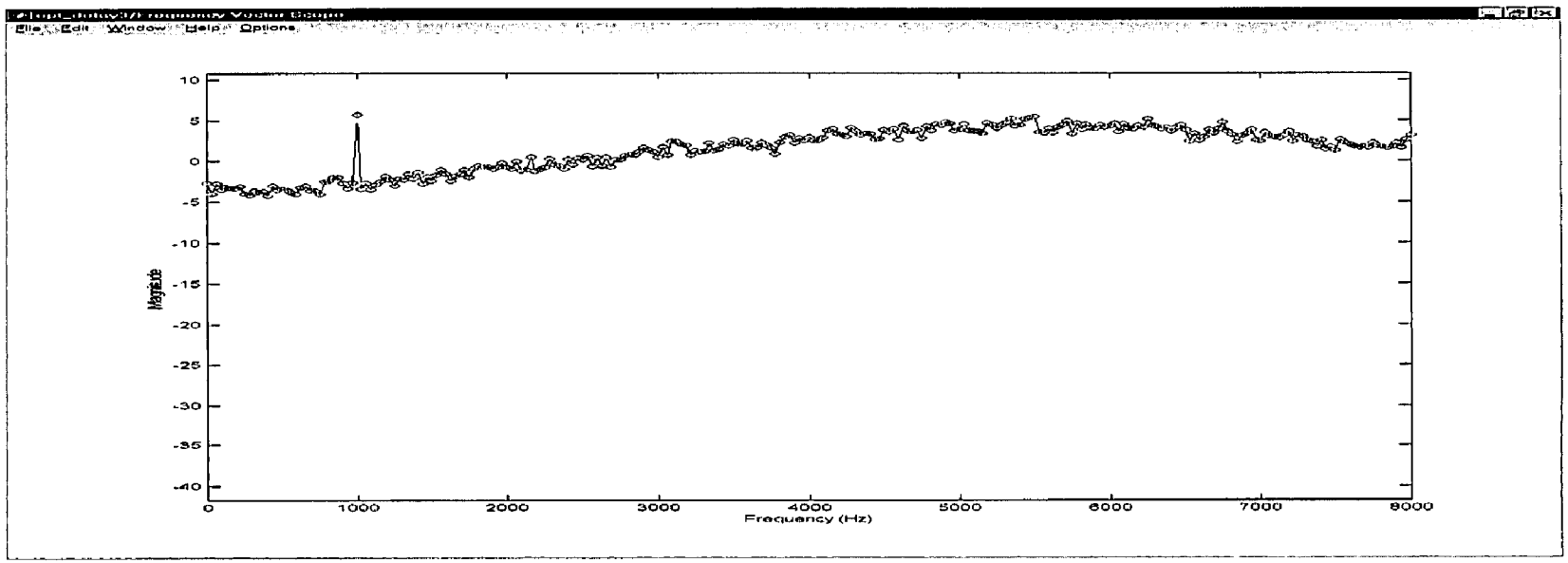
Figure 3D:
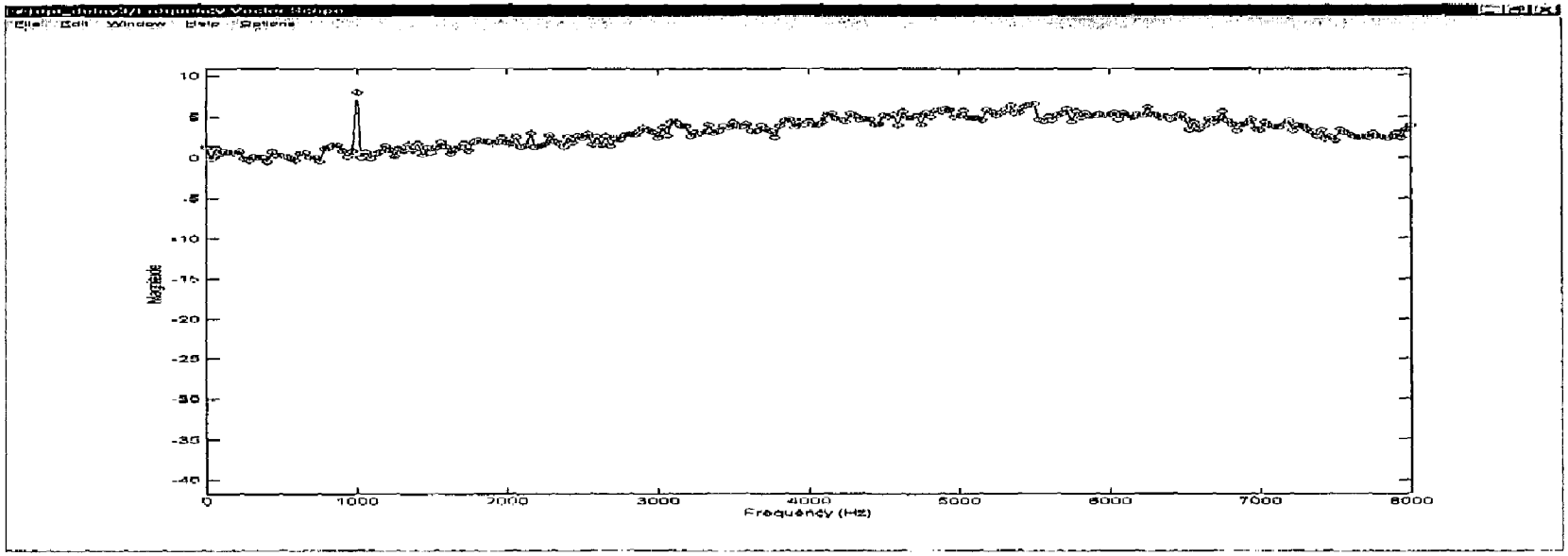
Figure 5:
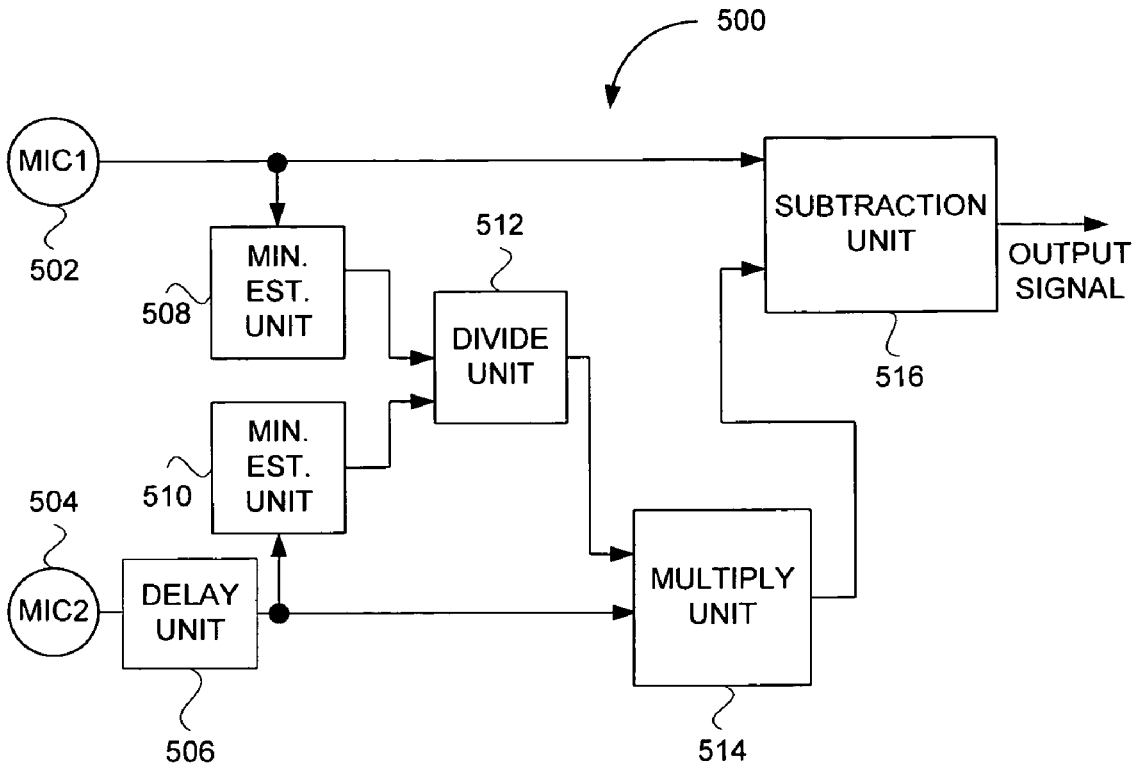
FIG. 5 is a block diagram of a two-microphone directional processing system according to one embodiment of the invention.

FIG. 5 is a block diagram of a two-microphone directional processing system 500 according to one embodiment of the invention. The two-microphone directional processing system 500 includes a first microphone 502 and a second microphone 504. The first microphone 502 produces a first electronic sound signal and the second microphone 504 produces a second electronic sound signal. A delay unit 506 delays the second electronic sound signal. The two-microphone directional processing system 500 also includes a first minimum estimate unit 508, a second minimum estimate unit 510 and a divide unit 512. The first minimum estimate unit 508 estimates the minimum for the first electronic sound signal. The second minimum estimate unit 510 estimates the minimum of the second electronic sound signal. Typically, these minimums are measured over a time constant duration, such that the minimum is a relatively long-term minimum. The divide unit 512 produces a quotient by dividing the first minimum estimate by the second minimum estimate. The quotient represents a scaling amount that is sent to a multiplication unit 514. The second electronic sound signal is then multiplied with the scaling amount to produce a compensated sound signal. The compensated sound signal is thus compensated (or corrected) for the relative difference in sensitivity between the mismatched first and second microphones 502 and 504. A subtraction unit 516 then subtracts the compensated electronic sound signal from the first electronic sound signal to produce an output signal. At this point, the output signal has been processed by the two-microphone directional processing system 500 to have robust directionality despite a mismatch between the first and second microphones 502 and 504.

The two-microphone directional processing system 500 uses a single-band adaptive compensation scheme to compensate for sensitivity differences between the microphones. In this embodiment, minimum estimates and division calculations are performed. The minimum estimates can, for example, be performed by minimum estimate units shown in more detail below with respect to FIGS. 7 and 8. It should also be noted that the delay unit 506 can be positioned within the two-microphone directional processing system 500 anywhere in the channel associated with the second electronic sound signal prior to the subtraction unit 516. Still further, it should be noted that a multiple-band adaptive compensation scheme could alternatively be utilized.

Moreover, although the two-microphone directional processing system 500 uses minimum estimates of the electronic sound signals produced by the first and second microphones 502 and 504, other signal characteristics can alternatively be used. For example, Root-Mean-Square (RMS) average of the electronic sound signals produced by the microphones could be used. With such an approach, the RMS average could be measured over a time constant duration. The time constant can be set such that the average is relatively long-term so as to avoid impact of signal fluctuations. The time constant with an RMS approach is likely to be longer than the time constant for the minimum approach.

The two-microphone directional processing system 500 operates to scale the intensity of an electronic sound signal from one or more of the microphones. With respect to the two-microphone directional processing system 500, the processing (including the scaling) is performed in a linear domain. However, the scaling or other processing can also be performed in a logarithm (or dB) domain.

Figure 6:
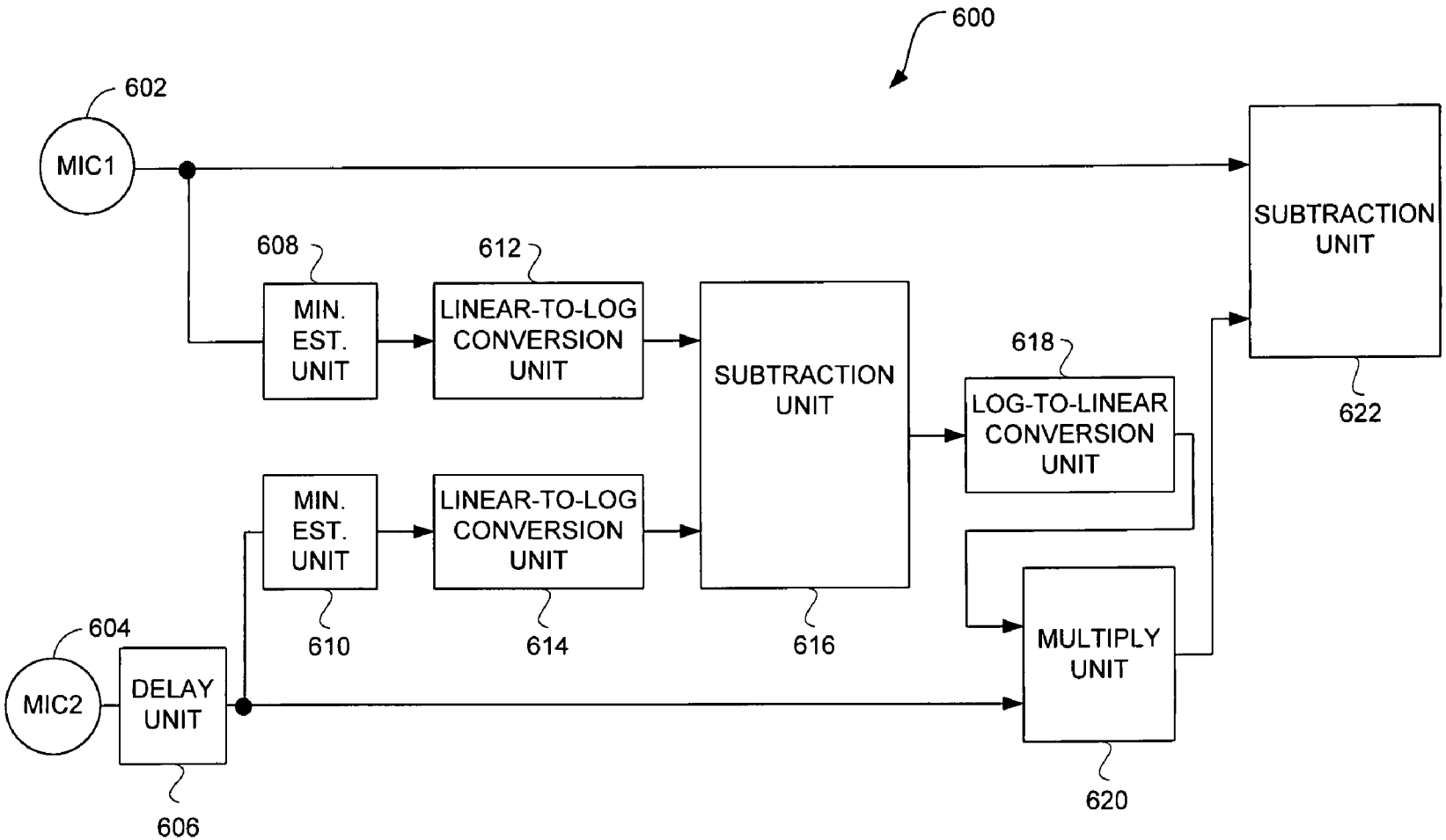
FIG. 6 is a block diagram of a two-microphone directional processing system according to another embodiment of the invention.

FIG. 6 is a block diagram of a two-microphone directional processing system 600 according to another embodiment of the invention. The two-microphone directional processing system 600 includes a first microphone 602 and a second microphone 604. The first microphone 602 produces a first electronic sound signal and the second microphone 604 produces a second electronic sound signal. A delay unit 606 delays the second electronic sound signal. The two-microphone directional processing system 600 also includes a first minimum estimate unit 608 and a second minimum estimate unit 610. The first minimum estimate unit 608 estimates the minimum for the first electronic sound signal. The second minimum estimate unit 610 estimates the minimum of the second electronic sound signal. Typically, these minimums are measured over a time constant duration, such that the minimum is a relatively long-term minimum.

The two-microphone directional processing system 600 also includes a first linear-to-log conversion unit 612, a second linear-to-log conversion unit 614, a subtraction unit 616, and a log-to-linear conversion unit 618. The first minimum estimate is converted from the linear domain to the logarithm domain by the first linear-to-log conversion unit 612, and the second minimum estimate is converted from the linear domain to the logarithm domain by the second linear-to-log conversion unit 614. The subtraction unit 616 then subtracts the second minimum estimate from the first minimum estimate to produce a difference amount. The log-to-linear conversion unit 614 then converts the difference amount to the linear domain.

The converted difference amount produced by the log-to-linear conversion unit 614 represents a scaling amount that is sent to a multiplication unit 620. The second electronic sound signal is then multiplied with the scaling amount to produce a compensated sound signal. The compensated sound signal is thus compensated (or corrected) for the relative difference in sensitivity between the mismatched first and second microphones 602 and 604. A subtraction unit 622 then subtracts the compensated electronic sound signal from the first electronic sound signal to produce an output signal. The output signal has been processed by the two-microphone directional processing system 500 to have robust directionality despite a physical mismatch between the first and second microphones 602 and 604.

It should be noted that the two-microphone directional processing system 600 is generally similar to the two-microphone directional processing system 500 illustrated in FIG. 5. Both use similar circuitry to produce a single-band adaptive compensation scheme for a multi-microphone directional processing system. However, the divide unit 512 shown in FIG. 5 is replaced by the linear-to-log conversion units 612 and 614, the subtraction unit 616 and the log-to-linear conversion unit 618 shown in FIG. 6. Mathematically, the divide unit 512 is equivalent to the combination of the linear-to-log conversion units 612 and 614, the subtraction unit 616 and the log-to-linear conversion unit 618. However, with certain approximations, the design shown in FIG. 6 may be able to perform a "divide" operation more efficiently. Also the delay unit 606 in FIG. 6 can be positioned anywhere in the channel associated with the second electronic sound signal prior to the subtraction unit 622.

Figure 7:
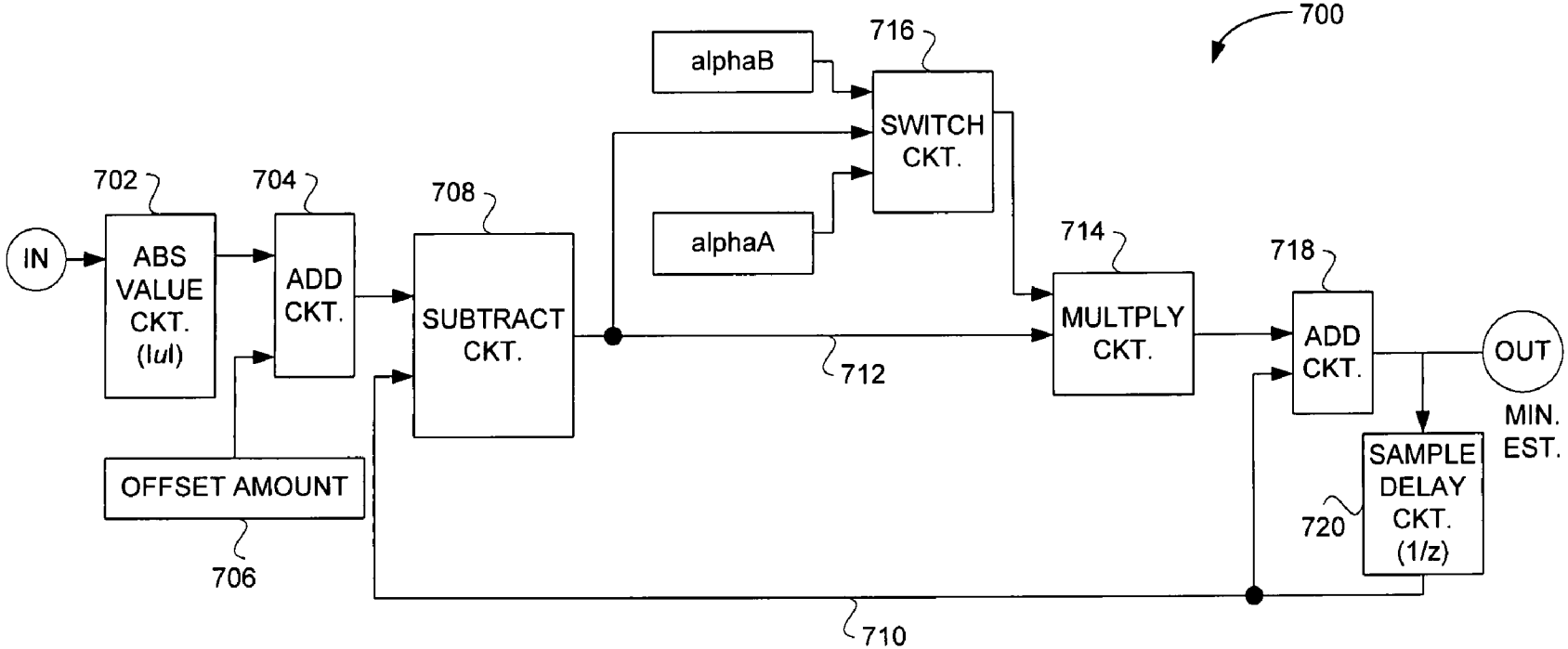
FIG. 7 is a block diagram of a minimum estimate unit according to one embodiment of the invention.

FIG. 7 is a block diagram of a minimum estimate unit 700 according to one embodiment of the invention. The minimum estimate unit 700 is, for example, suitable for use as the minimum estimate units discussed above with respect to FIGS. 5 and 6. The minimum estimate unit 700 receives an input signal (e.g., electronic sound signal) that is to have its minimum estimated. The input signal is supplied to an absolute value circuit 702 that determines the absolute value of the input signal. An add circuit 704 adds the absolute value of the input signal together with an offset amount 706 and thus produces an offset absolute value signal. The addition of the offset amount, which is typically a small positive value, such as 0.000000000001, is used to avoid overflow in division or logarithm calculations performed in subsequent circuitry in the multi-microphone directional processing systems. The offset absolute value signal from the add circuit 704 is supplied to a subtract circuit 708. The subtract circuit 708 subtracts a previous output 710 from the offset absolute value signal to produce a difference signal 712. The difference signal 712 is supplied to a multiply circuit 714. In addition, the difference signal 712 is supplied to a switch circuit 716. The switch circuit 716 selects one of two constants that are supplied to the multiply circuit 714. A first of the constants is referred to as alphaB and is supplied to the multiply circuit 714 when the difference signal 712 is greater than or equal to zero. Alternatively, a second constant, alphaA, is supplied to the multiply circuit 714 when the difference signal 712 is not greater than or equal to zero. The constants, alphaA and alphaB, are typically small positive values, with alphaA being greater than alphaB. In one implementation, alphaA is 0.00005 and alphaB is 0.000005. The multiply circuit 714 multiplies the difference signal 712 by the selected constant to produce an adjustment amount. The adjustment amount is supplied to an add circuit 718. The add circuit 718 adds the adjustment amount to the previous output 710 to produce a minimum estimate for the input signal. A sample delay circuit 720 delays the minimum estimate by a delay (1/z) to yield the previous output 710 (where 1/z represents a delay operation).

Figure 8:
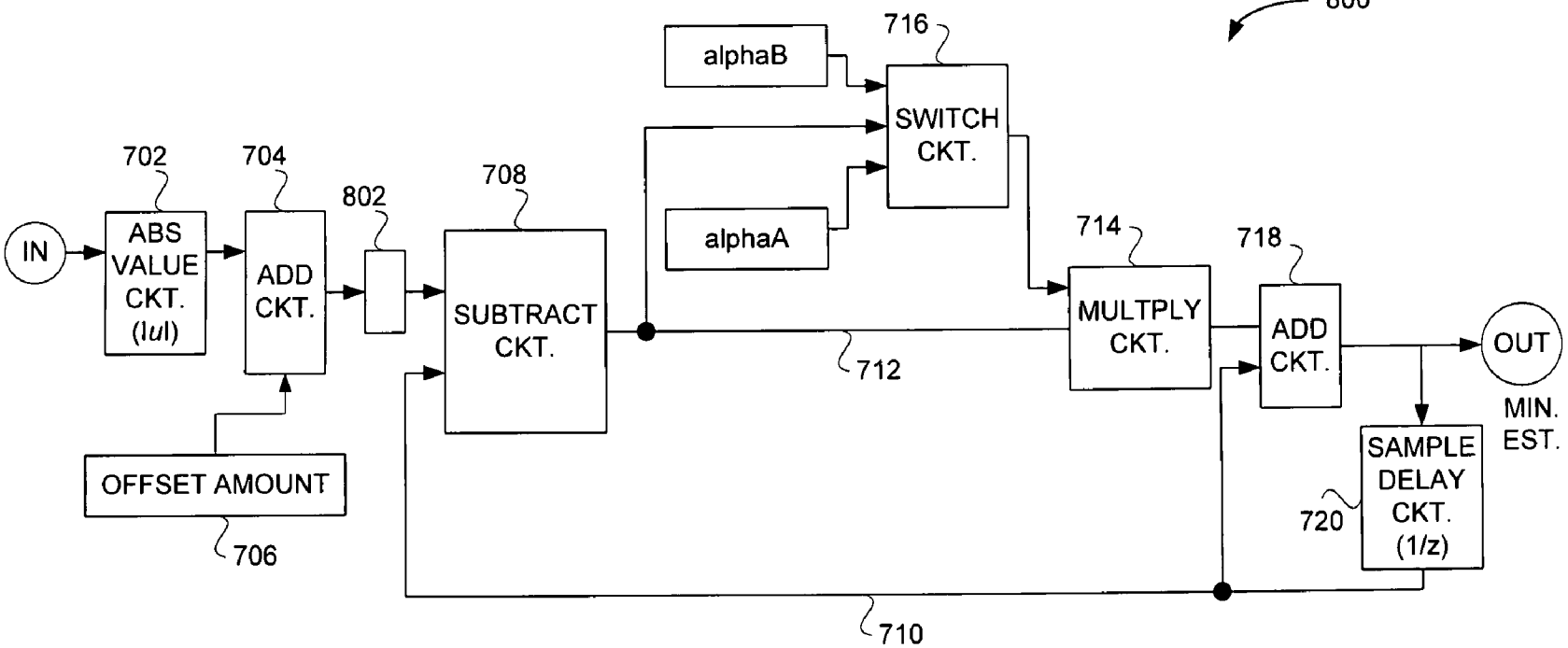
FIG. 8 is a block diagram of a minimum estimate unit according to another embodiment of the invention.

FIG. 8 is a block diagram of a minimum estimate unit 800 according to another embodiment of the invention. The minimum estimate unit 800 is, for example, similar in design to the minimum estimate unit 700 illustrated in FIG. 7. The minimum estimate unit 800, however, further includes a linear-to logarithm conversion unit 802 that converts the offset absolute value signal into a logarithmic offset signal before being supplied to the subtract circuit 708.

The minimum estimate unit 800 is, for example, suitable for use as the minimum estimate units discussed above with respect to FIG. 6. Note that, however, the linear-to-logarithm conversion units 612 and 614 would not be needed when the minimum estimate unit 800 is used in the system because there is already a linear-to-logarithm conversion unit inside the minimum estimate unit 800.

The two constants, alphaA and alphaB, are used in the minimum estimate units 700, 800 to determine how the minimum estimate changes with the input signal. Because the constant alphaA is greater than the constant alphaB, the minimum estimate tracks the value level (or minimum level) of the input signal. Since the value level is typically a good indicator of the noise level in the sound, the minimum estimate produced by the minimum estimate units 700, 800 is a good indicator of background noise level.

Figure 9:
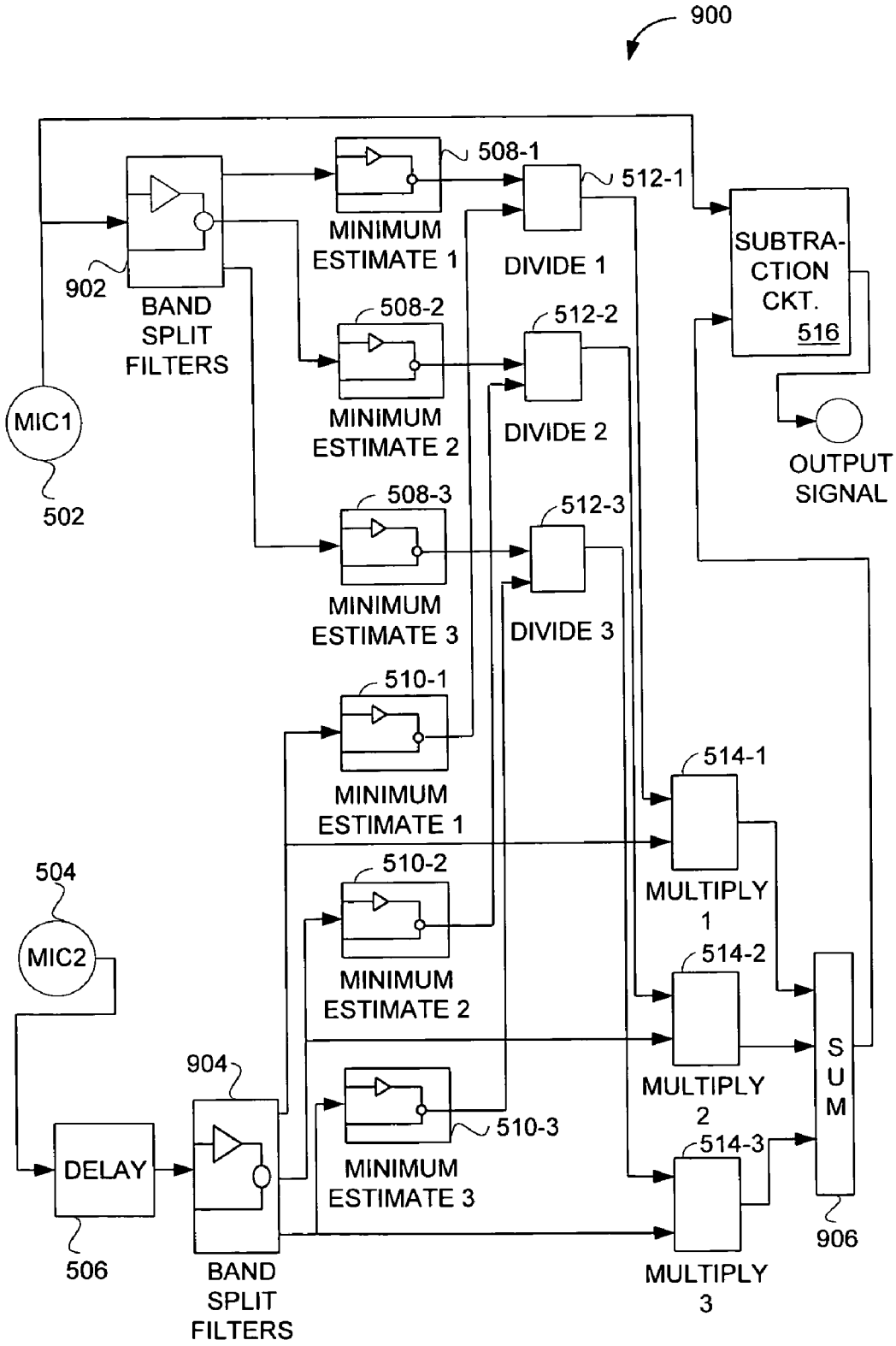
FIG. 9 is a block diagram of a multi-microphone directional processing system that operates to perform multi-band adaptive compensation for microphone mismatch.

As noted above, the present invention can also be implemented in circuits that utilize multi-band adaptive compensation for mismatch of microphone sensitivities. FIG. 9 is a block diagram of a multi-microphone directional processing system 900 that operates to perform multi-band adaptive compensation for microphone mismatch. Although any number of bands can be used, the multi-microphone directional processing system 900 uses three bands. The multi-microphone directional processing system 900 is generally similar in operation to the two-microphone directional processing system 500 illustrated in FIG. 5. However, the multi-microphone directional processing system 900 further includes band split filters 902 and 904 that divide or separate the electronic sound signals from each of the microphones into different frequency ranges. Typically, the band split banks would be the same for each microphone. The band split filters 902 split the first electronic sound signal into first, second and third partial sound signals that are respectively delivered to minimum estimate circuits 508-1, 508-2 and 508-3. The minimum estimates produced by the minimum estimate circuits 508-1, 508-2 and 508-3 are respectively supplied to the divide circuits 512-1, 512-2 and 512-3. The divide circuits 512-1, 512-2 and 512-3 yield first, second and third scaling amounts. The first, second and third scaling amounts produced by the divide circuits 512-1, 512-2 and 512-3 are respectively supplied to the multiply circuits 514-1, 514-2 and 514-3. The multiply circuits 514-1, 514-2 and 514-3 respectively multiply the first, second and third partial sound signals for the second electronic sound signal by the corresponding first, second and third scaling amounts to produce first, second and third partial scaled second electronic sound signals. The first, second and third partial scaled second electronic sound signals output from the multiply circuits 514-1, 514-2 and 514-3 are then summed by a sum circuit 906 to produce the compensated sound signal. The compensated sound signal is thus compensated (or corrected) for the relative difference in sensitivity between the mismatched first and second microphones 502 and 504. The compensated sound signal is then subtracted from the first electronic sound signal by the subtraction circuit 516 to produce the output signal.

Figure 10:
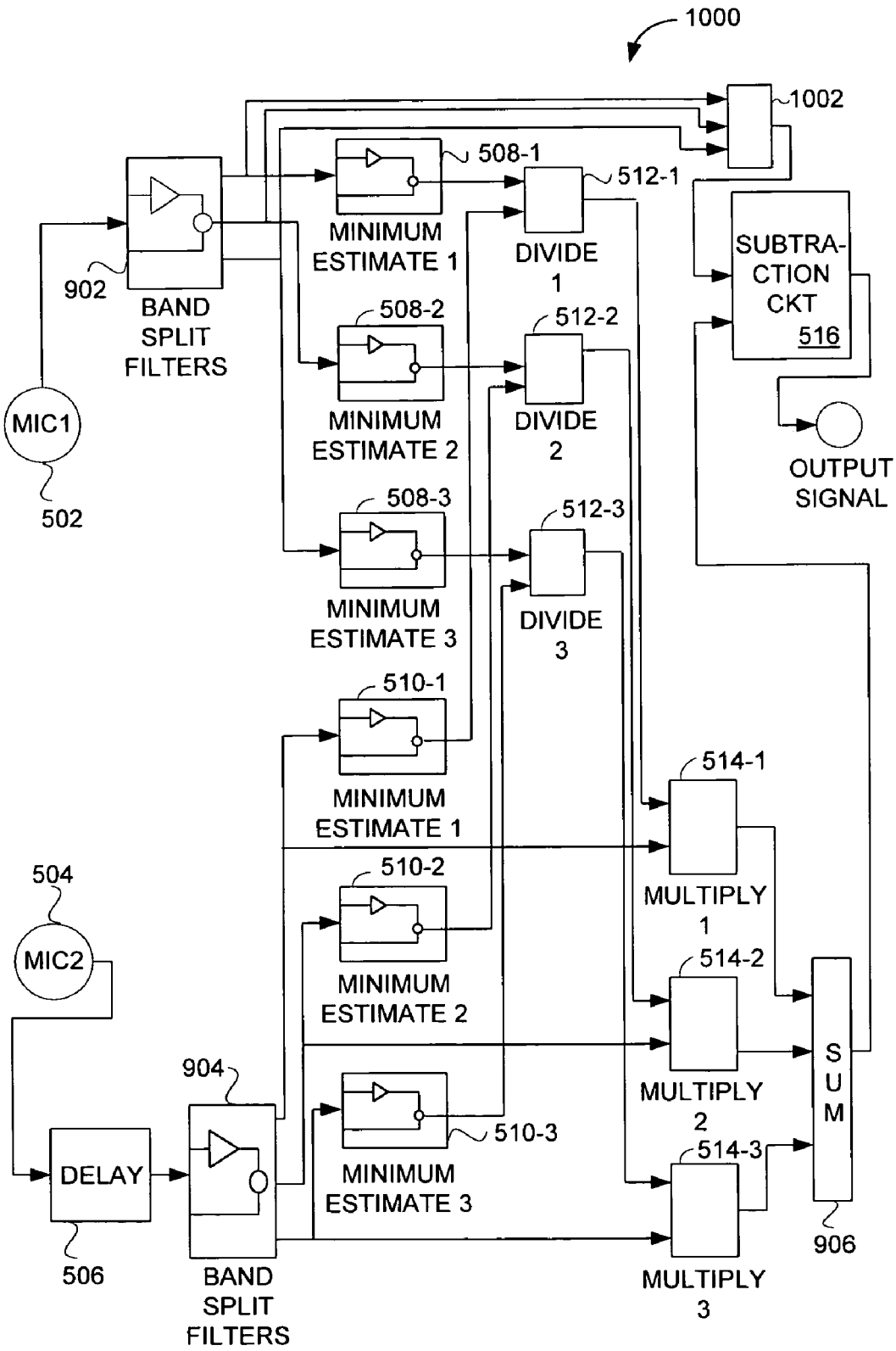
FIG. 10 is a block diagram of a multi-microphone directional processing system according to one embodiment of the invention.

FIG. 10 is a block diagram of a multi-microphone directional processing system 1000 according to one embodiment of the invention. The multi-microphone directional processing system 1000 illustrated in FIG. 10 is generally similar to the multi-microphone directional processing system 900 illustrated in FIG. 9. However, the multi-microphone directional processing system 1000 further includes a sum circuit 1002. The sum circuit 1002 operates to sum each of the partial first electronic sound signals produced by the band split filters 902 prior to being supplied to the subtraction circuit 518. The multi-microphone directional processing system 1000 thus compensates for delay induced by the band split filters 902 and 904 by addition of the sum circuit 1002 to the multi-microphone directional processing system 1000.

Figure 11:
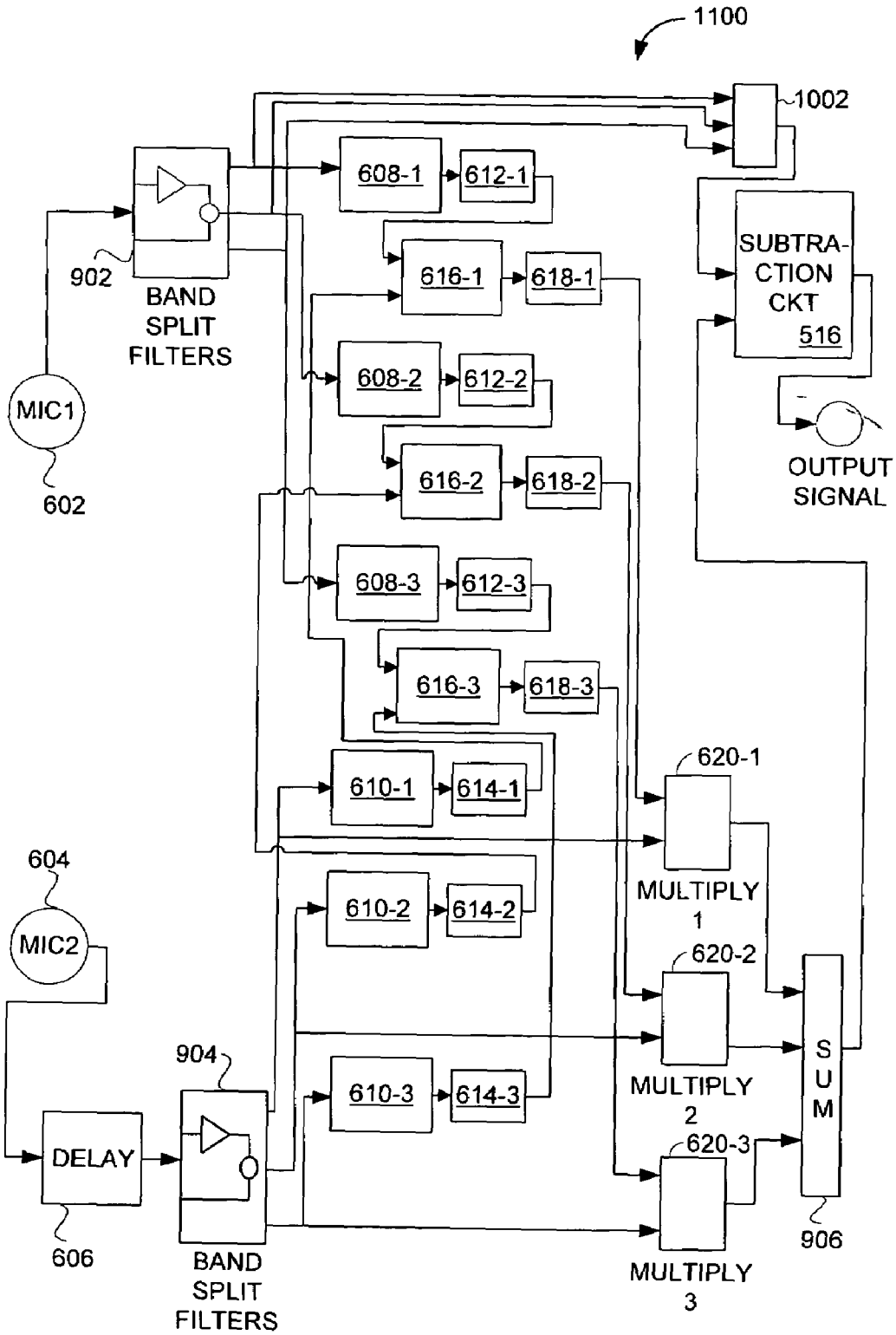
FIG. 11 is a block diagram of a multi-microphone directional processing system according to another embodiment of the invention.

FIG. 11 is a block diagram of a multi-microphone directional processing system 1100 according to another embodiment of the invention. The multi-microphone directional processing system 1100 includes the band split filters 902 and 904 as discussed above with respect to FIG. 9, and optionally includes the sum circuit 1002 as discussed above with respect to FIG. 10. In addition, like FIG. 6, the multi-microphone directional processing system 1100 utilizes the logarithm domain to effectively perform division operations in a multi-band adaptive manner. Hence, FIG. 11 represents a multi-band adaptive compensation scheme using the approach discussed above with respect to FIG. 6.

The invention is preferably implemented in hardware, but can be implemented in software or a combination of hardware and software. The invention can also be embodied as computer readable code on a computer readable medium. The computer readable medium is any data storage device that can store data which can be thereafter be read by a computer system. Examples of the computer readable medium include read-only memory, random-access memory, CD-ROMs, magnetic tape, optical data storage devices, carrier waves. The computer readable medium can also be distributed over a network coupled computer systems so that the computer readable code is stored and executed in a distributed fashion.

The advantages of the invention are numerous. Different embodiments or implementations may yield one or more of the following advantages. One advantage of the invention is that directional noise suppression is not affected by microphone mismatch. Another advantage of the invention is that the directional noise suppression is not affected by the drift of microphone sensitivity over time. Still another advantage of the invention is that directional noise suppression is not affected by the non-uniform distribution of sound pressure in real-life application. Thus, the invention enables the multi-microphone system processing system to achieve superior directionality and consistent Signal-to-Noise Ratio (SNR) across all conditions.

The many features and advantages of the present invention are apparent from the written description and, thus, it is intended by the appended claims to cover all such features and advantages of the invention. Further, since numerous modifications and changes will readily occur to those skilled in the art, it is not desired to limit the invention to the exact construction and operation as illustrated and described. Hence, all suitable modifications and equivalents may be resorted to as falling within the scope of the invention.

What is claimed is:

1. An adaptive directional sound processing system, comprising:

at least first and second microphones spaced apart by a predetermined distance, said first microphone producing a first electronic sound signal and said second microphone producing a second electronic sound signal;

a first minimum estimate circuit operatively coupled to said first microphone, said first minimum estimate circuit produces a first minimum estimate for the first electronic sound signal from said first microphone;

a second minimum estimate circuit operatively coupled to said second microphone, said second minimum estimate circuit produces a second minimum estimate for the second electronic sound signal from said second microphone;

a divide circuit operatively connected to said first and second minimum estimate circuits, said divide circuit operates to produce a scaling signal from the first and second minimum estimates;

a multiply circuit operatively connected to said divide circuit and said second microphone, said multiply circuit operates to multiply the second electronic sound signal by the scaling signal to produce a scaled second electronic sound signal; and a subtraction circuit operatively connected to said multiply circuit and said first microphone, said subtraction circuit producing an output difference signal by subtracting the scaled second electronic sound signal from the first electronic sound signal.

2. An adaptive directional sound processing system as recited in claim 1, wherein said adaptive directional sound processing system further comprises:

a delay circuit that delays the second electronic sound signal or the scaled second electronic sound signal by a delay amount.

3. An adaptive directional sound processing system as recited in claim 1, wherein said divide circuit operates in a linear domain.

4. An adaptive directional sound processing system as recited in claim 1, wherein said divide circuit operates in a logarithm domain.

5. An adaptive directional sound processing system as recited in claim 1, wherein said divide circuit comprises:

a first linear-to-logarithm conversion circuit operatively coupled to said first minimum estimate circuit to produce a converted first minimum estimate circuit;

a second linear-to-logarithm conversion circuit operatively coupled to said second minimum estimate circuit to produce a converted second minimum estimate circuit;

a subtraction circuit operatively connected to said a first linear-to-logarithm conversion circuit and said second linear-to-logarithm conversion circuit to produce a difference signal; and a logarithm-to-linear conversion circuit operatively connected to said subtraction circuit to converted the difference signal to the scaling signal.

6. An adaptive directional sound processing system as recited in claim 1, wherein at least one of said first minimum estimate circuit and said second minimum estimate circuit comprises:

a subtraction circuit that subtracts the first electronic sound signal from a previous minimum estimate in producing a difference signal;

a multiply circuit that multiplies the difference signal by a scale amount to produce an adjustment amount; and an addition circuit that adds the adjustment amount to the previous minimum estimate in producing a current minimum estimate.

7. An adaptive directional sound processing system as recited in claim 1, wherein, wherein said adaptive directional sound processing system resides within a hearing aid device.

8. A method for adaptively measuring and compensating for acoustical differences between sound signals picked up by microphones, said method comprising:

(a) receiving first and second electronic sound signals from first and second microphones, respectively;

(b) determining a compensation scaling amount that compensates for acoustic differences with respect to the first and second microphones;

(c) scaling the second electronic sound signal in accordance with the compensation scaling amount; and (d) producing a differential electronic sound signal by subtracting the scaled second electronic sound signal from the first electronic sound signal, wherein said determining (b) comprises:

(b1) determining a first minimum estimate of the first electronic sound signal;

(b2) determining a second minimum estimate of the second electronic sound signal; and (b3) dividing the first minimum estimate by the second minimum estimate to produce the compensation scaling amount.

9. A method as recited in claim 8, wherein the acoustic differences pertain to at least differences in microphone sensitivity.

10. A method as recited in claim 8, wherein the microphones are provided within a hearing aid device, and wherein said method is performed by the hearing aid device.

11. A method for adaptively measuring and compensating for acoustical differences between sound signals picked up by microphones, said method comprising:

(a) receiving first and second electronic sound signals from first and second microphones, respectively;

(b) determining a compensation scaling amount that compensates for acoustic differences with respect to the first and second microphones;

(c) scaling the second electronic sound signal in accordance with the compensation scaling amount; and (d) producing a differential electronic sound signal by subtracting the scaled second electronic sound signal from the first electronic sound signal, wherein said determining (b) comprises: p2 (b1) measuring a sensitivity difference between the first and second microphones while in use; and (b2) producing the compensation scaling amount based on the sensitivity difference, wherein the acoustic differences pertain to at least differences in microphone sensitivity, and wherein said measuring (b1) of the sensitivity difference is performed using minimum estimates of the first and second sound signals or maximum estimates of the first and second sound signals.

12. A method as recited in claim 11, wherein the microphones are provided within a hearing aid device, and wherein said method is performed by the hearing aid device.

13. A method for adaptively measuring and compensating for acoustical differences between sound signals picked up by microphones, said method comprising:

(a) receiving first and second electronic sound signals from first and second microphones, respectively;

(b) determining a compensation scaling amount that compensates for acoustic differences with respect to the first and second microphones;

(c) scaling the second electronic sound signal in accordance with the compensation scaling amount; and (d) producing a differential electronic sound signal by subtracting the scaled second electronic sound signal from the first electronic sound signal, wherein said determining (b) comprises:

(b1) determining a first minimum estimate of the first electronic sound signal;

(b2) determining a second minimum estimate of the second electronic sound signal;

(b3) converting the first minimum estimate to a logarithm scale first minimum estimate;

(b4) converting the second minimum estimate to a logarithm scale second minimum estimate;

(b5) subtracting the logarithm scale second minimum estimate from the logarithm scale first minimum estimate to produce a difference signal; and (b6) converting the difference signal from the logarithm scale to a linear scale, the converted difference signal being the compensation scaling amount.

14. A method as recited in claim 13, wherein the microphones are provided within a hearing aid device, and wherein said method is performed by the hearing aid device.

* * * * *